US010479649B2

(12) United States Patent
Colenutt

(10) Patent No.: US 10,479,649 B2
(45) Date of Patent: Nov. 19, 2019

(54) OVER-SPEED DETECTION DEVICE FOR STAIRLIFTS

(71) Applicant: Stannah Stairlifts Limited, Andover, Hampshire (GB)

(72) Inventor: Martin John Colenutt, Hampshire (GB)

(73) Assignee: Stannah Stairlifts Limited, Hampshire (GB)

( * ) Notice: Subject to any disclaimer, the term of this patent is extended or adjusted under 35 U.S.C. 154(b) by 315 days.

(21) Appl. No.: 15/318,875

(22) PCT Filed: Jun. 15, 2015

(86) PCT No.: PCT/GB2015/051748
§ 371 (c)(1),
(2) Date: Dec. 14, 2016

(87) PCT Pub. No.: WO2015/193646
PCT Pub. Date: Dec. 23, 2015

(65) Prior Publication Data

US 2017/0144860 A1 May 25, 2017

(30) Foreign Application Priority Data

Jun. 16, 2014 (GB) ..... 1410668.6

(51) Int. Cl.
*B66B 5/04* (2006.01)
*B66B 9/08* (2006.01)

(52) U.S. Cl.
CPC ..... *B66B 5/044* (2013.01); *B66B 9/0815* (2013.01); *B66B 9/08* (2013.01)

(58) Field of Classification Search
CPC ..... B66B 5/044; B66B 5/046; B66B 9/08; B66B 9/0807; B66B 9/0815; B66B 9/0823; B66B 9/0838; B66B 9/0846; F16D 11/04
See application file for complete search history.

(56) References Cited

U.S. PATENT DOCUMENTS 1,209,099 A * 12/1916 Wunning ..... B66B 5/18 187/352
2,811,228 A * 10/1957 Borden ..... B66B 5/044 188/189

(Continued)

FOREIGN PATENT DOCUMENTS

CN 102259783 A 11/2011
CN 103771212 A 5/2014

(Continued)

OTHER PUBLICATIONS

United Kingdom Search Report dated Dec. 2, 2014 pertaining to GB Patent Application No. 1410668.6.

(Continued)

*Primary Examiner* — Minh Truong
(74) *Attorney, Agent, or Firm* — Dinsmore & Shohl LLP

(57) ABSTRACT

An over-speed detection device (OSDD) and over-speed governor (OSG) for a stairlift is tripped by flyweights which displace from a rotational axis of the OSDD/OSG when subjected to an over-speed. The outward displacement of the flyweights is converted into an axial displacement to effect triggering of the OSG. This ensures that the tripping speed is independent of the angle if inclination of the stairlift rail. The OSDD/OSG may be mounted so that it takes its drive from a convex surface of the rail in negative transition bends. This ensures that the speed of the OSDD/OSG is maintained close to the tripping speed even when the carriage is slowed to traverse the negative transition bend.

15 Claims, 7 Drawing Sheets

(56) References Cited

U.S. PATENT DOCUMENTS

| | | | | |
|---|---|---|---|---|
| 2,888,099 | A | 5/1959 | Hoffmann | |
| 3,084,766 | A | 4/1963 | Donaldson | |
| 3,415,343 | A | 12/1968 | Svensson | |
| 6,659,230 | B1 | 12/2003 | Jenkins | |
| 2003/0024771 | A1* | 2/2003 | Takai | B66B 5/044 187/373 |
| 2011/0024237 | A1* | 2/2011 | Vroegindeweij | B66B 9/0838 187/201 |
| 2012/0103732 | A1* | 5/2012 | Kwon | B66B 5/044 187/305 |
| 2018/0201480 | A1* | 7/2018 | Shi | B66B 5/044 |

FOREIGN PATENT DOCUMENTS

| | | | |
|---|---|---|---|
| GB | 25601 | A | 3/1911 |
| GB | 191025601 | A | 3/1911 |
| GB | 2074673 | A | 11/1981 |
| WO | 0044663 | A1 | 8/2000 |
| WO | 2004014773 | A1 | 2/2004 |

OTHER PUBLICATIONS

International Search Report and Written Opinion dated Oct. 23, 2015 pertaining to International Application No. PCT/GB2015/051745.

* cited by examiner

OVER-SPEED DETECTION DEVICE FOR STAIRLIFTS

FIELD OF THE INVENTION

This invention relates to a stairlifts and, in particular, to an over-speed detection device (OSDD) for a stairlift. Typically an OSDD is combined with a safety gear mechanism to provide an over-speed governor (OSG). The invention further covers a stairlift fitted with an OSDD and/or an OSG and to novel methods of configuring and/or operating a stairlft.

BACKGROUND TO THE INVENTION

It is a requirement that a stairlift includes an OSDD to detect if the stairlift carriage exceeds a speed prescribed in regulations. If there is a possibility of drive failure leading to free-fall of the carriage, the OSDD must be combined with a safety gear mechanism which, when triggered by the OSDD, will bring the stairlift carriage to a halt.

There are two main classes of OSDD and/or OSG. The first class operates by means of one or more weights that displace, typically centrifugally under excess speed, to provide a triggering action. An example of this type of OSDD/OSG is described in our European Patent No. 1 149 041. A second class of OSDD generates an electronic signal representative of the speed of the stairlift carriage and compares this with a pre-determined threshold to decide if a triggering action, typically the triggering of a safety-gear mechanism, should be effected. An example of this type of OSDD/OSG is described in our European Patent No. 1 539 628.

Regulations currently in force governing the construction and operation of stairlifts do not accommodate OSDDs of the second class and, accordingly, the OSDD and OSG described and claimed herein belongs in the first class. Certain requirements and limitations apply to OSDDs and OSGs, particularly of the first class described. These include:

i) There is limited space in the stairlift carriage to accommodate an OSDD and OSG and thus the physical dimensions of the device should be as small as possible.

ii) Because of the geometry of the OSG described in EP 1 149 041, and of similar devices, the tripping speed varies with changes in the vertical inclination of the rail. It therefore follows that a trip speed range must be provided based on both rail angle and carriage speed. This, in turn, limits the overall speed capability of the stairlift if unintended tripping is to be avoided.

iii) Currently OSDDs and OSGs of the first class are driven at the same speed as the carriage, yet regulations require the stairlift carriage, in the event of drive failure, to be brought to a halt before the carriage has moved a significant distance, and without the chair going off-level by more than 10°. Clearly, in the event of failure, if the carriage is moving more slowly than a normal rated speed, a longer distance will be required for the OSDD and/or OSG to operate.

iv) Following on from iii), as a stairlift carriage is driven through a negative transition bend in the stairlift rail, the speed of the carriage must be reduced. For the purposes of this disclosure a negative transition bend is defined as a bend in a vertical plane that reduces in inclination when traveling in an upward direction. The speed reduction is necessary to release sufficient battery power to operate the chair leveling mechanism and/or to ensure that the speed reference point (as defined in EN 81-40:2008 (E)) on the carriage, which is some distance above the axis of rotation of the bend, does not exceed a prescribed speed. A problem thus arising is that, if there is a failure in the main drive while the carriage is passing through a negative transition bend, the OSDD will also be operating at a lower speed and the carriage will therefore move a significant distance before the OSDD is not just brought back up to the rated speed, but beyond the rated speed to the tripping speed.

It is an object of the present invention to provide a stairlift, and/or an over-speed detection device and/or over-speed governor for a stairlift, and/or a method of configuring and/or operating a stairlift that will go at least some way to addressing the aforementioned drawbacks and/or requirements; or which will at least provide a novel and useful choice.

SUMMARY OF THE INVENTION

Accordingly, in a first aspect, the invention provides an over-speed detection device for a stairlift said detection device having a rotary drive for engagement with a stairlift rail, at least one weight operatively connected to said rotary drive and being rotatable about an axis, said at least one weight having a centre of mass such that rotation of said weight about said axis above a pre-determined speed effects displacement of said centre of mass away from said axis; and a triggering facility operatively connected to said at least one weight and being displaced as said centre of mass is displaced away from said axis, said over-speed governor being characterised in that said triggering facility is displaced in a direction substantially parallel to said axis.

Preferably said at least one weight comprises a plurality of weights incorporated into a flywheel assembly, said flywheel assembly further including a hub aligned with said axis and rotatable with said weights about said axis, a connection being provided between said weights and said hub, the connection being configured to effect rotation of said hub relative to said weights as the centres of mass of said weights are displaced away from said axis.

Preferably each of said weights is connected to said hub, the connections being configured to ensure that displacement of the centre of mass of one weight effects equal displacement of the centres of mass of the other weights Preferably said triggering facility comprises said hub and a trip slider in contact with said hub and being displaceable along said axis, said trip slider and said hub having inter-engaging surfaces configured to cause axial displacement of said trip slider as said hub is rotated relative to said weights.

Preferably at least one of said inter-engaging surfaces is helical in form.

In a second aspect the invention provides an over-speed governor for a stairlift, said over-speed governor comprising an over-speed detection device as set forth above, and a safety gear mechanism operatively connected to said triggering facility, said safety gear mechanism being displaceable into contact with a stairlift rail.

Preferably said safety gear mechanism is displaceable into contact with said rail in a direction substantially parallel to said axis.

Preferably said safety gear mechanism is displaceable in an opposite direction to the direction of movement of said brake triggering facility.

In a third aspect, the invention provides an over-speed detection device for a stairlift, the stairlift including a rail, and a carriage moveable along said rail; said over-speed detection device being mountable in said carriage and including a rotary drive for contact with said rail, and at least one weight operatively connected to said rotary drive to rotate about an axis, wherein rotation of said at least one weight about said axis at a determined excess speed causes said weight to be displaced away from said axis, said over-speed detection device being characterised in that:

a transmission is provided between said rotary drive and said at least one weight to cause said at least one weight to be rotated about said axis at a rotational speed higher than the rotational speed of said rotary drive.

Preferably transmission includes a planet gear connected to said rotary drive and a pinion driven by said planet gear connected to said at least one weight.

Preferably said at least one weight comprises a plurality of weights incorporated into a flywheel assembly mounted on said axis.

Preferably said axis is parallel to, but offset from, a further axis about which said rotary drive rotates.

Preferably said transmission has a ratio of at least 1 to 4.

In a fourth aspect the invention comprises a stairlift including an over-speed detection device as set forth above.

In a fifth aspect the invention provides a method of configuring a stairlift, said stairlift having:

a stairlift rail;

a carriage displaceable along said rail;

a drive motor within said carriage;

a drive wheel driven by said drive motor said drive wheel engaging said rail along a pitch line, and an over-speed detection device included in said carriage, said over-speed governor having a rotary drive in contact with said rail, said method being characterized in that:

said over-speed detection device is positioned within said carriage so that said rotary drive engages said rail at a substantial distance from said pitch line.

Preferably said rail includes an upper edge and a lower edge, said method comprising configuring said stairlift so that said pitch line is at or adjacent to the lower edge of said rail and said rotary drive is engaged with the upper edge or a surface part of the rail adjacent to said upper edge.

Preferably said method further includes biasing said rotary drive into contact with said rail.

In a sixth aspect the invention provides a stairlift having:

a stairlift rail;

a carriage displaceable along said rail;

a drive motor within said carriage;

a drive wheel driven by said drive motor said drive wheel engaging said rail along a pitch line, and an over-speed detection device included in said carriage, said over-speed governor having a rotary drive in contact with said rail, said stairlift being characterized in that:

said over-speed detection device is positioned within said carriage so that said rotary drive engages said rail at a substantial distance from said pitch line.

Preferably said rail includes an upper edge and a lower edge, said pitch line being at or adjacent to the lower edge and said rotary drive engaging the upper edge or a surface part of the rail adjacent to said upper edge.

Preferably said rotary drive is biased into contact with said rail.

In a seventh aspect the invention provides a method of operating a stairlift, said stairlift having:

a stairlift rail, said rail having a negative transition bend (as herein defined) therein;

a carriage displaceable along said rail;

a drive motor to drive said carriage along said rail;

an over-speed detection device operable to detect when the speed of said carriage along said rail exceeds a predetermined speed, said method including slowing the speed of said carriage as said carriage moves through a negative transition bend and being characterized in that it comprises increasing the speed of said over-speed detection device as said carriage moves through a negative transition bend.

Preferably said method comprises effecting an increase in the speed of said over-speed detection device by driving said over-speed device from a surface on said rail that is convex in a negative transition bend.

Preferably said method comprises driving said over-speed detection device from substantially the upper surface of said rail.

In an eighth aspect the invention provides a stairlift having a stairlift rail, said rail having a negative transition bend (as herein defined) therein;

a carriage displaceable along said rail;

an over-speed detection device in driving contact with said rail and being operable to detect when the speed of said carriage along said rail exceeds a predetermined speed, said stairlift being characterized in that when said carriage is moving through a negative transition bend, said over-speed detection device is in driving contact with a convex surface of said rail.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The various aspects of the invention will now be described with reference to the accompanying drawings in which.

DETAILED DESCRIPTION OF WORKING EMBODIMENT

Figure 1:
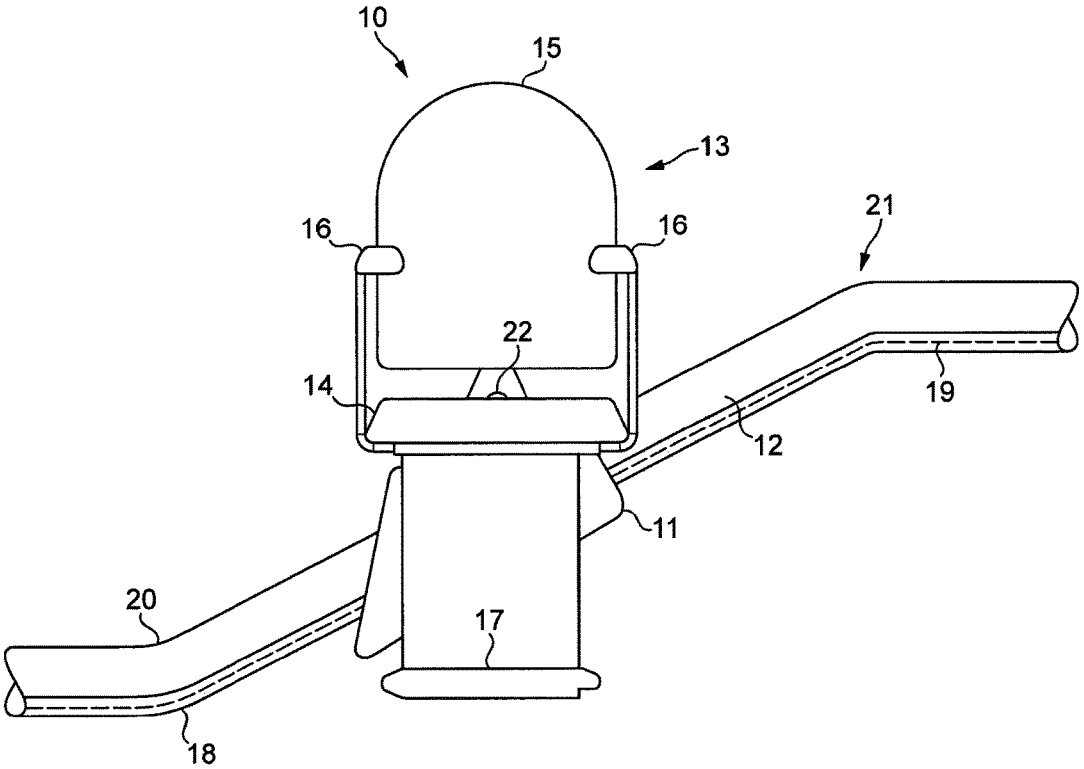
FIG. 1: shows a schematic configuration of a stairlift to which the invention might be applied.

Referring to FIG. 1, the invention relates to a stairlift 10 comprising a carriage 11 mounted on a rail 12. A chair 13 is mounted on the carriage 12, the chair 13 having a seating surface 14, a backrest 15, a pair of armrests 16 and a footrest 17.

Located within the carriage 11 is a main drive motor (not shown) to drive the carriage along the rail in a known manner, and a chair levelling motor (not shown) to pivot the chair relative to the carriage so as to maintain the seating surface 14 level as the carriage moves up and down the rail and, in particular, as the carriage traverses bends in the rail. This levelling function is well known to those skilled in the art.

Figure 2:
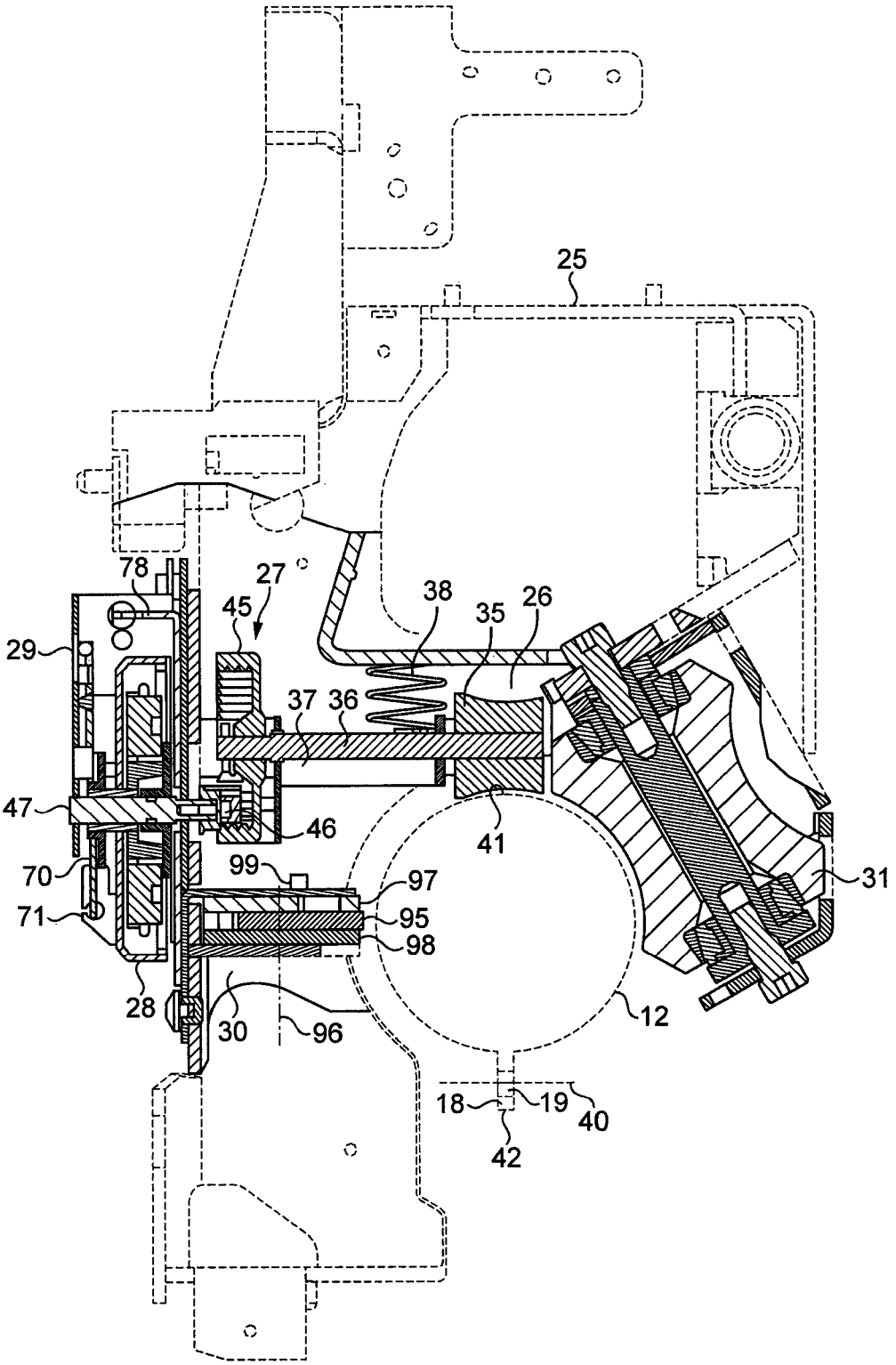
FIG. 2: shows a cross-section of a stairlift OSG according to the invention.

In the form shown, and as can be seen more clearly in FIG. 2, the rail 12 is formed from sections of round tube, a tang or drive flange 18 projecting downwardly from the bottom surface of each rail section. When the rail sections are joined end-to-end, the flanges 18 combine to provide a continuous drive surface that may include evenly-spaced apertures 19 there-along into which the teeth of a drive pinion (not shown) engage.

In the form shown in FIG. 1, the rail 12 includes a positive transition bend 20 and a negative transition bend 21. As used herein, the term negative transition bend means a bend in a vertical plane in which the angle of inclination reduces when moving in an upward direction. A positive transition bend is the opposite of this.

Also shown in FIG. 1 is speed reference point 22. The speed reference point is defined in the European Standard EN81-40:2008 (E) and is a point on the longitudinal centreline of the seat surface 14, 250 mm forward of a vertical line down through the forward face of the backrest 15.

Referring now to FIG. 2, the invention provides an over-speed governor (OSG) for fitment into the carriage 11 of stairlift 10, parts of the carriage being indicated in dotted outline at 25. In the particular embodiment described the OSG comprises a combination of over-speed detection device (OSDD) and a safety gear mechanism but in other applications the OSDD only might be provided.

The OSG comprises a number of sub-sections including a rotary drive 26 which provides drive to the OSG as the carriage moves along the rail, a transmission 27, a flywheel assembly 28, an actuation mechanism 29 and a safety gear mechanism 30. Although not strictly part of the OSG, a thrust roller 31 is mounted in the carriage 11, in a position substantially diametrically opposed to the contact point of the safety gear mechanism 30 to ensure that, in the event the OSG is actuated, the safety gear mechanism is maintained securely in contact with the rail 12.

The rotary drive conveniently comprises a tyred roller 35 mounted at one end of input shaft 36. The input shaft 36 is, as shown, rotatably supported in carrier 37 which is capable of limited pivotal movement. Springs 38 are conveniently provided to bias the carrier downwardly and, thus, the tyred roller 35 into contact with the rail 12.

A particular feature of the rotary drive 26 is that roller 35 contacts the rail 12 at a position significantly above the pitch line 40 of the rail when the rail is viewed in cross-section, the pitch line being a line through the drive apertures 19 in the tang 18. In this particular embodiment the roller 35 takes its drive from the upper edge 41 of the rail which is the maximum possible distance from the pitch line that is adjacent to the lower edge 42 of the rail. It will be appreciated that, in negative transition bends, the surface defined by the upper rail edge 41 and indeed any continuous line on the rail above the rail centreline, is convex. Accordingly, as the carriage moves through a negative transition bend, the rotary drive 26 is driven at a greater speed than the drive speed of the carriage as measured at the pitch line 40. This is important as, in general, carriage speed must be reduced in negative transition bends to release sufficient battery power to enable the levelling motor to function effectively. A reduction in speed may also be required to prevent the speed at the reference point 22 exceeding that prescribed in the standard and/or to avoid user discomfort. As described above, the reduction in carriage speed would, according to the prior art, mean the speed of the OSG would also be reduced meaning, in turn, that a user would be particularly vulnerable in the event of drive failure in a negative transition bend as the OSG would be significantly below its trip speed. The present invention ensures that the speed of the OSG relative to the speed of the carriage is increased in negative transition bends and thus helps to compensate for the carriage speed reduction.

The input shaft 36 transfers drive to the transmission 27. The transmission 27 comprises a planet gear 45 mounted on the inner end of input shaft 36, for rotation with the input shaft. Mounted for geared engagement with the planet gear 45 is a pinion 46, the pinion 46 being mounted on flywheel shaft 47. It will be appreciated that the speed of the flywheel shaft 47 will be stepped-up relative to the speed of input shaft 36, the ratio of the two speeds being determined by the relative numbers of teeth on the gears 45 and 46. The precise gear ratio is not a characterising feature of the invention but a step-up ratio of at least 1:4 is preferred. It will be seen that the axis of the flywheel shaft 47 is offset from the axis of the input shaft 36 which can help in packaging the OSG within the confined space of the carriage. Further, by gearing up the speed of the flywheel shaft relative to the input shaft, smaller weights can be used in the flywheel thus reducing the size of the OSG and making it easier to house with the carriage.

Figure 5:
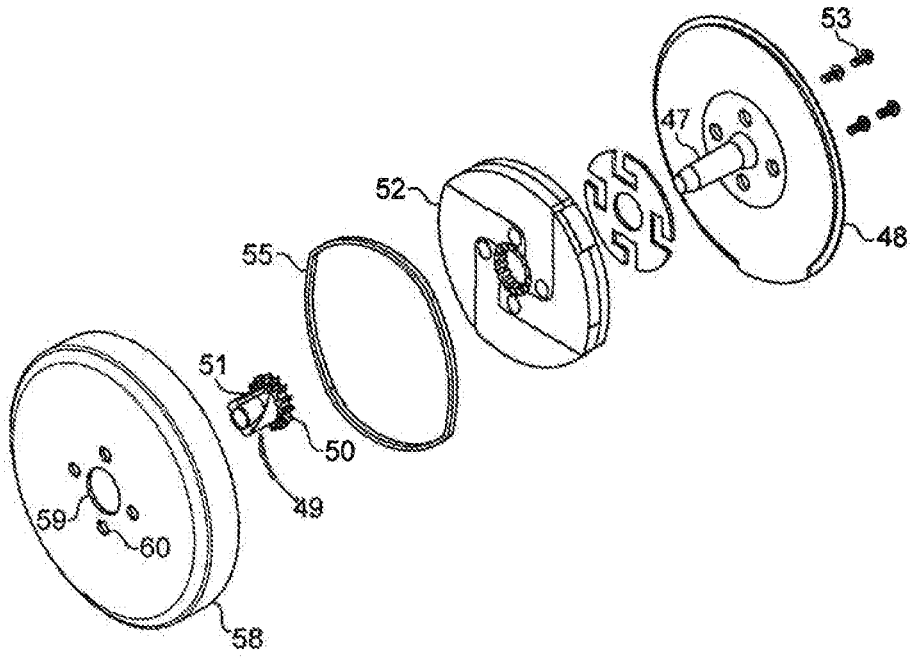
FIG. 5: shows an isometric exploded view of a flywheel assembly forming part of the OSG shown in the previous figures.
Figure 7A:
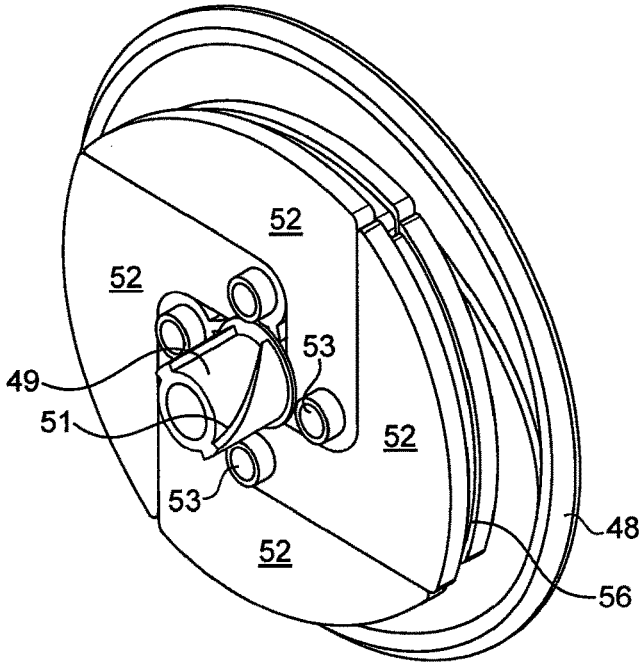
FIGS. 7*a*: show a first embodiment of flyweights in nested and and 7*b* expanded states respectively.
Figure 7B:
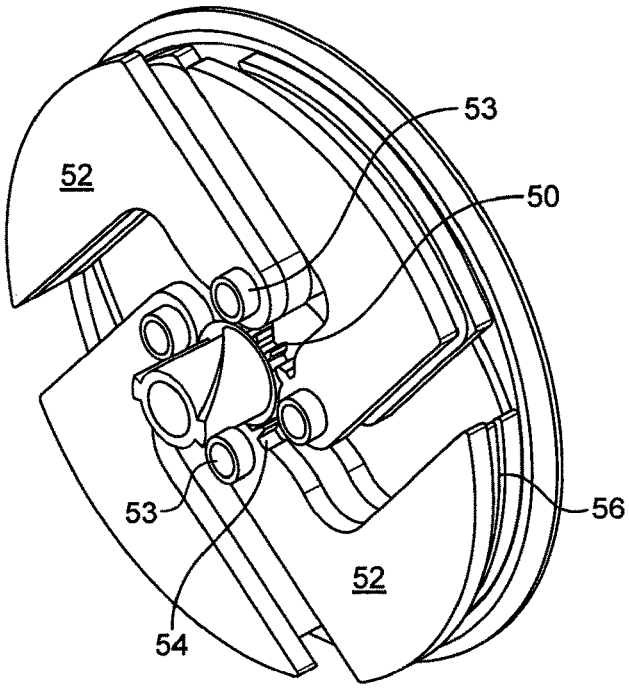

Referring now to FIG. 5, the flywheel shaft 47 forms part of the flywheel assembly 28. In the form shown, shaft 47 projects inwardly from flywheel base plate 48 and mounted firstly on shaft 47 is a hub 49. As will be explained in greater detail below, the hub 49 forms part of a triggering facility and includes a gear ring 50 around the rear edge thereof and a helical surface 51 extending along its length. As can be seen in FIGS. 7*a* and 7*b*, the flyweight, in this embodiment comprising four individual nested flyweights 52 is fitted over the hub 49, the individual flyweights being mounted to the base plate 48 on tubular studs 53 such that each flyweight 52 can pivot on its respective stud 53. As can best be seen from FIG. 7*b*, at least one of the flyweights 52 includes a tooth 54 on its inner end such that when the flyweights are assembled on to the hub 32, the tooth 54 engages gear 50 on the hub. It will be appreciated that as the flywheel assembly 28 rotates, flyweights 52 rotate about the studs 53 and movement of the tooth 54 against the gear 50 causes the hub to turn relative to the flyweights.

Figure 8A:
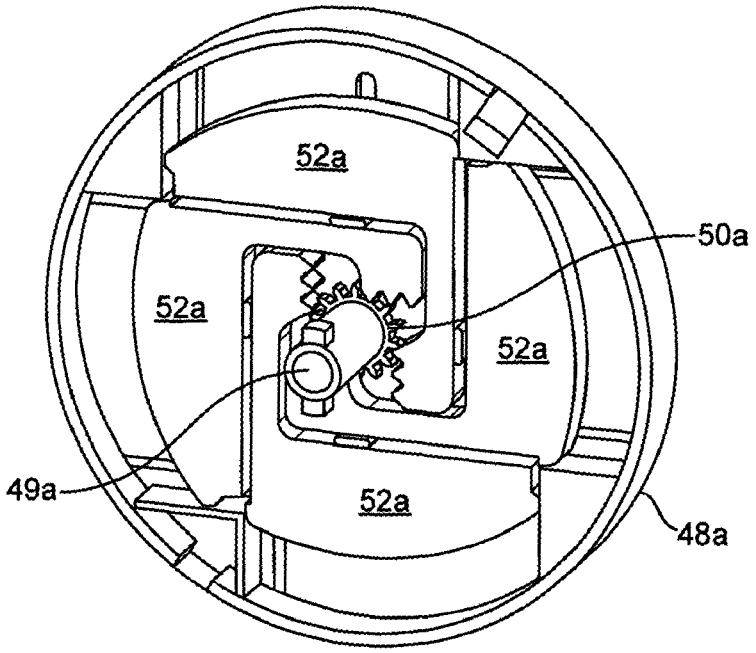
FIGS. 8*a*: show a second embodiment of flyweights in nested and and 8*b* expanded states respectively.
Figure 8B:
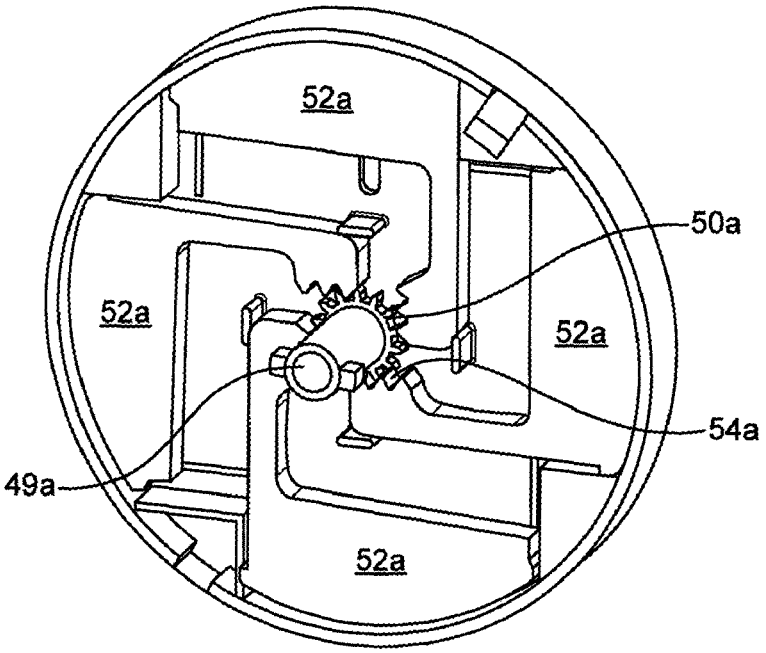

An alternative arrangement of flyweights is shown in FIGS. 8*a* and 8*b*. In this embodiment the individual weights 52*a* are not mounted on pivots but displace in linear directions in guide-ways moulded into the base plate 48*a*. The connections between the individual weights 52*a* and the hub 49*a* can be better seen in FIGS. 8*a* and 8*b*, each weight having gear teeth 54*a* that engage the gear 50*a* on the hub. As a result, not only is the hub 49*a* rotated relative to the weights as the weights displace outwardly, but the displacement of all the weights 52, 52*a* happen simultaneously and to the same extent.

Also shown in FIG. 5 is a circular retaining spring 55 that is positioned in grooves 56 provided on the outer edges of the flyweights to bias the flyweights toward the retracted positions shown in FIGS. 7*a* and 8*a*, and a cover 58 that fixes to base plate 48 and encloses the hub 49 and flyweights 52.

Figure 6:
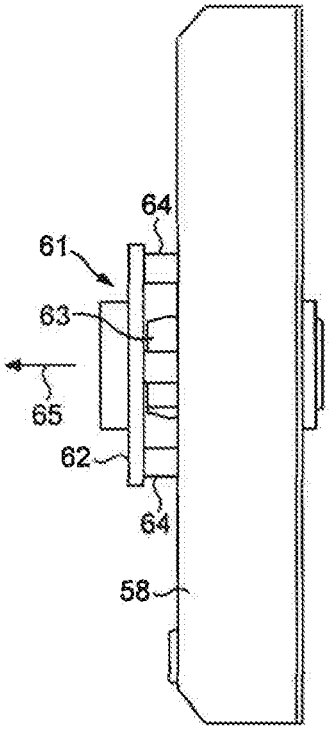
FIG. 6: shows, in a larger scale, a side view of a flywheel assembly including the components shown in FIG. 5.

In the form shown the cover 58 has a central aperture 59 and four smaller apertures 60 that correspond in position to the positions of studs 53. The apertures 59 and 60 serve to mount a trip slider 61 that can be seen in FIG. 6. The trip slider 61 includes a tripping surface 62 mounted on one end of a central tubular mount 63, the internal bore of which is a sliding fit over hub 49 and has a inwardly projecting surface part (not shown) that engages with helical surface 51 on the hub. The slider 61 further includes four mounting legs 64 that project through the apertures 60 and locate in the hollow studs 53. In this way the rotational position of the slider 61 is fixed with respect to the cover 58 but, as shown in FIG. 7*b*, as the flyweights displace outwardly under speed and overcome the resistance imposed by retaining spring 55, hub 49 is turned relative to the weights and the inter-engaging helical surfaces between the hub and the trip slider cause the trip slider 61 to displace axially in the direction of arrow 65.

Figure 9A:
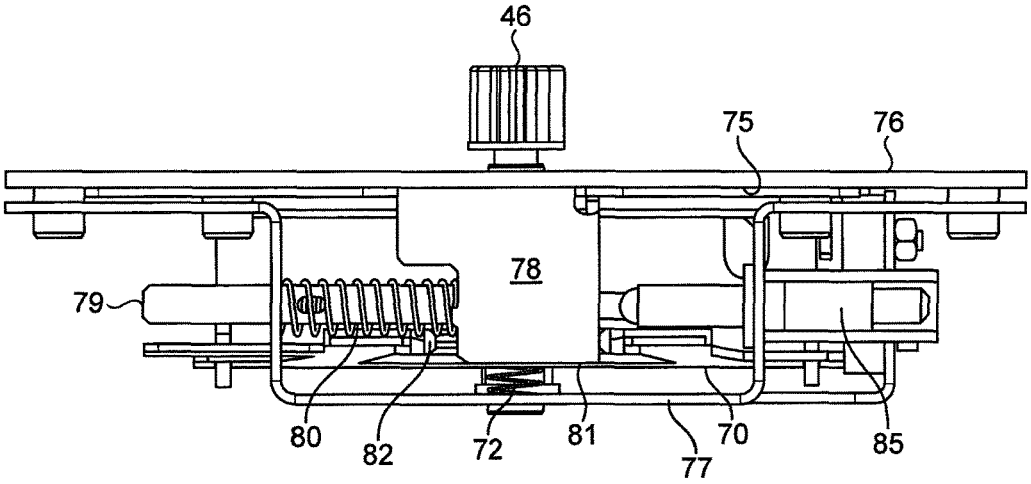
FIGS. 9*a*: show two positions of a safety gear actuation plate in an and 9*b* armed position and a triggered position respectively
Figure 9B:
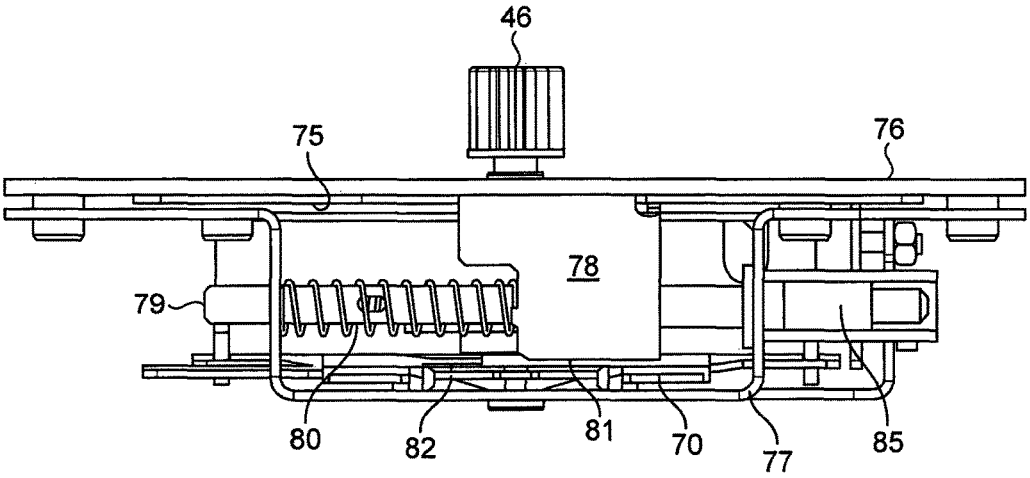

Turning now to FIGS. 9*a* and 9*b*, the trip slider 61 is positioned to contact the safety gear actuation mechanism 29. More particularly trip plate 70, pivotally mounted at its bottom edge at 71, is held against tripping surface 62 of the trip slider 61 by compression springs 72. Mounted within the actuating mechanism is a sliding actuation plate 75 which is sandwiched between back plate 76 and switch plate 77. The back plate 76 and switch plate 77 are so mounted to one another that the actuation plate can slide there-between. The upper edge of the actuation plate is folded over or otherwise provided with a horizontal trigger plate 78 that overlies the flywheel assembly.

The trigger plate 78 includes a spring retainer 79 that projects through an aperture in the switch plate 77 and mounted on which is a coil spring 80 that is compressed between the inner surface of switch plate 77, and the trigger plate 78. The outer end 81 of trigger plate is formed to engage in aperture 82 provided in the upper edge of trip plate 70.

When the OSG is in the armed or non-operating position the trigger plate 78 is engaged with the trip plate 70 and is held, against the bias of spring 80, in the position shown in FIG. 9*a*. If and when the tripping speed of the OSG is reached, the flyweights 52 displace outwardly overcoming the resistance of retaining spring 55 and the action of the hub 49 causes slider 61 to displace in the direction of arrow 65. As the slider 61 is displaced in the direction of arrow 65, the trip plate 70 is displaced out of contact with the trigger plate 78 and the trigger plate 78 is then displaced to the position shown in FIG. 9*b* by expansion of the spring 80. As the trigger plate 78 is displaced it actuates stop switch 85 which cuts power to the stairlift drive motor (not shown).

Figure 3:
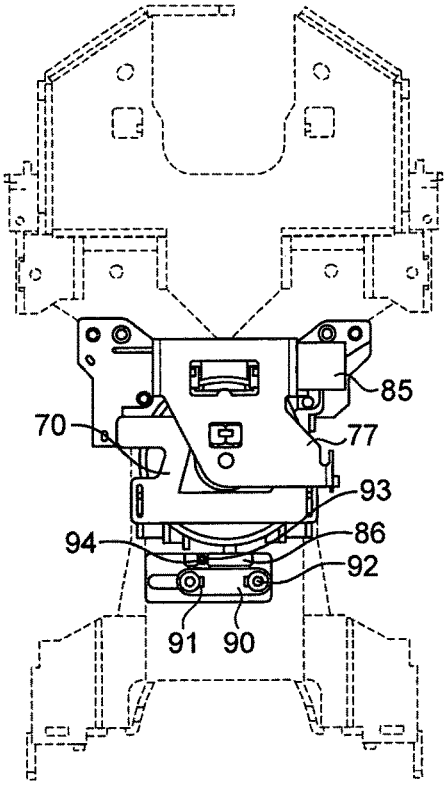
FIG. 3: shows another view of the stairlift OSG shown in FIG. 2.
Figure 4:
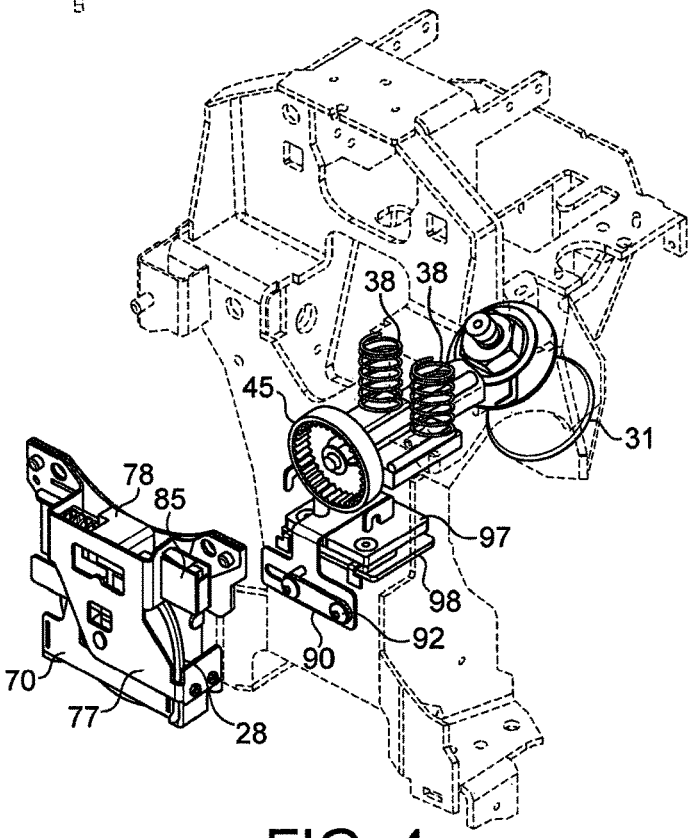
FIG. 4: shows, in a smaller scale, an isometric exploded view of the components shown in FIG. 2.

Referring now to FIGS. 2 and 3, as the trigger plate 78 displaces to the position shown in FIG. 9*b*, the safety gear mechanism is preferably deployed to engage the surface of the rail 12 and bring the brake the carriage to a halt. To this end, the lower end of the actuation plate 75 is formed into a foot 86, the foot 86 effecting displacement of the safety gear mechanism 30. In the particular embodiment described herein, the safety gear mechanism includes a cam slide plate 90 mounted by way of slotted apertures 91 on fastenings 92. Fixed to the cam slide plate is a pin 93 that engages in slot 94 in the foot 86. Thus as the actuation plate slides between the positions shown in FIGS. 9*a* and 9*b*, so the cam slide plate 90 slides on its fastenings 92. The cam slide plate projects over a braking cassette comprising a braking cam 95 pivotally mounted along axis 96 between upper and lower plates 97 and 98 respectively. Stud 99 fixed to the braking cam 95, but offset from axis 96, engages the cam slide plate 90 so that, when the cam slide plate 90 is displaced by the actuation plate 75, the braking cam 95 is displaced into contact with the rail 12. It will be appreciated that, due to the offset mounting of the braking cam 95, once contact is made with the rail 12, the cam is pulled more firmly into engagement with the rail as the carriage attempts to continue moving relative to the rail.

Whilst many variants will present themselves to those skilled in the art, the OSDD/OSG in the form described above has a number of significant advantages over prior art OSGs including:

i) The arrangement of the flywheel assembly in which the outward displacement of the flyweights is converted into an axial triggering action provides an OSDD/OSG whose tripping speed is independent of the angle of inclination of the rail.

ii) By driving the OSG off a surface of the rail that is convex in negative transition bends, the OSDD/OSG can be kept closer to its tripping speed, even when the carriage is slowed. This effectively addresses the worst possible mode of drive failure that is, at present, failure while the stairlift is traversing a negative transition bend.

iii) The transmission that steps up the speed of rotation of the pick-up speed gives rise to the possibility of a more compact OSDD/OSG that can be accommodated more easily in the limited space within the carriage.

The invention claimed is:

1. An over-speed detection device for a stairlift, the detection device comprising:

a rotary drive for engagement with a stairlift rail;

at least one weight operatively connected to said rotary drive and being rotatable about an axis, said at least one weight having a center of mass such that rotation of said weight about said axis above a pre-determined speed effects a displacement of said center of mass away from said axis, said at least one weight comprising a plurality of weights incorporated into a flywheel assembly, said flywheel assembly further including a hub aligned coaxially with said axis and rotatable with said weights about said axis, said hub being connected to said weights such that said hub is rotated relative to said weights as the centers of mass of said weights are displaced away from said axis; and a triggering facility operatively connected to said weights and being displaced as said centers of mass of said weights are displaced away from said axis, said triggering facility being displaced in a direction substantially parallel to said axis, said triggering facility comprising said hub and a trip slider in contact with said hub, said trip slider being displaceable along said axis, said trip slider and said hub having inter-engaging surfaces configured to cause axial displacement of said trip slider as said hub is rotated relative to said weights.

2. An over-speed detection device according to claim 1, wherein each of said weights is connected to said hub such that displacement of the center of mass of one weight effects equal displacement of the centers of mass of the other weights.

3. An over-speed detection device according to claim 1, wherein at least one of said inter-engaging surfaces is helical in form.

4. An over-speed governor for a stairlift, said over-speed governor comprising:

an over-speed detection device according to claim 1; and a safety gear mechanism operatively connected to said triggering facility, said safety gear mechanism being displaceable into contact with a stairlift rail.

5. An over-speed governor according to claim 4, wherein said safety gear mechanism is displaceable into contact with said rail in a direction substantially parallel to said axis.

6. An over-speed governor according to claim 4, wherein said safety gear mechanism is displaceable in a direction opposite to the direction of movement of said triggering facility.

7. An over-speed detection device for a stairlift, the stairlift including a rail, and a carriage moveable along the rail, the over-speed detection device being mountable in the carriage, the over-speed detection device comprising:

a rotary drive for contact with the rail;

at least one weight operatively connected to said rotary drive to rotate about an axis, said at least one weight comprising a plurality of weights incorporated into a flywheel assembly, said flywheel assembly further including a hub aligned coaxially with said axis and rotatable with said weights about said axis, said hub being connected to said weights such that said hub is rotated relative to said weights as centers of mass of said weights are displaced away from said axis, wherein rotation of said weights about said axis at a determined excess speed causes said weights to be displaced away from said axis;

a triggering facility operatively connected to said weights and being displaced as said centers of mass of said weights are displaced away from said axis, said triggering facility being displaced in a direction substantially parallel to said axis, said triggering facility comprising said hub and a trip slider in contact with said hub, said trip slider being displaceable along said axis, said trip slider and said hub having inter-engaging surfaces configured to cause axial displacement of said trip slider as said hub is rotated relative to said weights; and a transmission provided between said rotary drive and said weights to cause said weights to be rotated about said axis at a rotational speed higher than a rotational speed of said rotary drive.

8. An over-speed detection device according to claim 7, wherein said transmission includes a planet gear connected to said rotary drive and a pinion driven by said planet gear connected to said weights.

9. An over-speed detection device according to claim 7, wherein said axis about which said weights rotate is parallel to, but offset from, a further axis about which said rotary drive rotates.

10. An over-speed detection device according to claim 7, wherein said transmission has a ratio of at least 1 to 4.

11. A stairlift including an over-speed detection device as claimed in claim 7.

12. A stairlift comprising:

a stairlift rail;

a carriage displaceable along said rail;

a drive motor disposed within said carriage;

a drive wheel driven by said drive motor, said drive wheel engaging said rail along a pitch line; and an over-speed governor included in said carriage, said over-speed governor having a rotary drive in contact with said rail, said over-speed governor being positioned within said carriage so that said rotary drive engages said rail at a substantial distance from said pitch line, said over-speed governor further comprising:

at least one weight operatively connected to said rotary drive and being rotatable about an axis, said at least one weight comprising a plurality of weights incorporated into a flywheel assembly, said flywheel assembly further including a hub aligned coaxially with said axis and rotatable with said weights about said axis, said hub being connected to said weights such that said hub is rotated relative to said weights as centers of mass of said weights are displaced away from said axis, said weights having the centers of mass such that rotation of said weights about said axis above a pre-determined speed effects a displacement of said centers of mass away from said axis; and a triggering facility operatively connected to said weights and being displaced as said centers of mass are displaced away from said axis, said triggering facility being displaced in a direction substantially parallel to said axis, said triggering facility comprising said hub and a trip slider in contact with said hub, said trip slider being displaceable along said axis, said trip slider and said hub having inter-engaging surfaces configured to cause axial displacement of said trip slider as said hub is rotated relative to said weights.

13. A stairlift according to claim 12, wherein:

said rail includes an upper edge and a lower edge, said pitch line being at or adjacent to the lower edge; and said rotary drive engages said upper edge or a surface part of the rail adjacent to said upper edge.

14. A stairlift according to claim 12, wherein said rotary drive is biased into contact with said rail.

15. A stairlift comprising:

a stairlift rail, said rail having a negative transition bend therein;

a carriage displaceable along said rail; and an over-speed detection device in driving contact with said rail and being operable to detect when a speed of said carriage along said rail exceeds a predetermined speed, the over-speed detection device comprising:

a rotary drive for engagement with said rail;

at least one weight operatively connected to said rotary drive and being rotatable about an axis, said at least one weight comprising a plurality of weights incorporated into a flywheel assembly, said flywheel assembly further including a hub aligned coaxially with said axis and rotatable with said weights about said axis, said hub being connected to said weights such that said hub is rotated relative to said weights as centers of mass of said weights are displaced away from said axis, said weights having the centers of mass such that rotation of said weights about said axis above a pre-determined speed effects a displacement of said centers of mass away from said axis; and a triggering facility operatively connected to said weights and being displaced as said centers of mass are displaced away from said axis, said triggering facility being displaced in a direction substantially parallel to said axis, said triggering facility comprising said hub and a trip slider in contact with said hub, said trip slider being displaceable along said axis, said trip slider and said hub having inter-engaging surfaces configured to cause axial displacement of said trip slider as said hub is rotated relative to said weights;

wherein when said carriage is moving through the negative transition bend, said over-speed detection device is in driving contact with a convex surface of said rail.

* * * * *